US007059976B2

(12) United States Patent
Hayashi et al.

(10) Patent No.: US 7,059,976 B2
(45) **Date of Patent: *Jun. 13, 2006**

(54) SOLID GOLF BALL

(75) Inventors: Junji Hayashi, Chichibu (JP); Hiroyuki Nagasawa, Chichibu (JP); Hideo Watanabe, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/946,116

(22) Filed: Sep. 22, 2004

(65) Prior Publication Data

US 2006/0063613 A1 Mar. 23, 2006

(51) Int. Cl.
*A63B 37/06* (2006.01)

(52) U.S. Cl. ..... 473/377; 473/378

(58) Field of Classification Search ..... 473/376, 473/351, 373, 374, 377
See application file for complete search history.

(56) References Cited

U.S. PATENT DOCUMENTS

| | | | | |
|---|---|---|---|---|
| 5,702,311 | A | 12/1997 | Higuchi et al. | |
| 5,779,564 | A | 7/1998 | Nakamura et al. | |
| 5,803,832 | A | 9/1998 | Nakamura et al. | |
| 5,807,192 | A | 9/1998 | Yamagishi et al. | |
| 5,820,492 | A | 10/1998 | Yamagishi et al. | |
| 6,045,461 | A | 4/2000 | Yamagishi et al. | |
| 6,688,992 | B1 * | 2/2004 | Takemura et al. | 473/378 |
| 2003/0013554 | A1 * | 1/2003 | Higuchi et al. | 473/371 |
| 2003/0017888 | A1 * | 1/2003 | Higuchi et al. | 473/371 |
| 2003/0125136 | A1 * | 7/2003 | Iwami | 473/378 |
| 2003/0158340 | A1 * | 8/2003 | Iwami | 525/184 |

FOREIGN PATENT DOCUMENTS

| | | | |
|---|---|---|---|
| JP | 7-268132 | A | 10/1995 |
| JP | 9-168610 | A | 6/1997 |
| JP | 2820060 | B2 | 8/1998 |
| JP | 10-230023 | A | 9/1998 |
| JP | 11-35633 | A | 2/1999 |
| JP | 2888168 | B2 | 2/1999 |
| JP | 2924698 | B2 | 5/1999 |
| JP | 3005066 | B2 | 11/1999 |
| JP | 3067611 | B2 | 5/2000 |
| JP | 3120717 | B2 | 10/2000 |
| JP | 2002-293996 | A | 10/2002 |

* cited by examiner

*Primary Examiner*—Raeann Gorden
(74) *Attorney, Agent, or Firm*—Sughrue Mion, PLLC

(57) ABSTRACT

Disclosed herein is a solid golf ball made up of a core and at least one cover, wherein said core is formed mainly from a polybutadiene which is synthesized with using a catalyst of rare earth element such that the content of cis-1,4 bond is no less than 60%, said core has a diameter of 34.7 to 42.0 mm, said core undergoes deflection amounting to 2.5 to 5.0 mm under a load of 100 kg, said cover has an outermost cover layer which is formed mainly from a thermoplastic resin or elastomer compounded with organic short fibers, said outermost cover layer has a Shore D hardness of 55 to 70 and a thickness of 0.5 to 2.0 mm, and said ball weighs 40.0 to 44.9 g. The solid golf ball excels in both flying performance and crack resistance and permits novice golfers to increase flying distance even when it is hit with a low head speed.

8 Claims, No Drawings

SOLID GOLF BALL

BACKGROUND OF THE INVENTION

There have been proposed several kinds of solid golf balls which are specified by the weight and density of the ball and the density and hardness of the core and cover. They are disclosed in Japanese Patent Nos. 3005066, 2924698, 2820060, 3067611, 3120717, and 2888168, and Japanese Patent Laid-open Nos. Hei 10-230023 and Hei 9-168610.

Unfortunately, these conventional solid golf balls are improved in flying distance but are poor in crack resistance. Moreover, some of them are good in crack resistance but poor in flying performance due to excessive spin.

In other words, none of them are satisfactory in both flying performance and crack resistance. Especially, they do not make the novice golfers satisfy with flying distance who merely achieve the head speed in the order of 30 m/s.

SUMMARY OF THE INVENTION

The present invention was completed in view of the foregoing. It is an object of the present invention to provide a solid golf ball which excels in both flying performance and crack resistance and permits novice golfers to increase flying distance even with low head speeds.

As the result of their extensive studies, the present inventors found that the above-mentioned object is achieved by a solid golf ball made up of a core and at least one cover layer, wherein the core is formed mainly from a polybutadiene which is synthesized with using a catalyst of rare earth element such that the content of cis-1,4 bond is no less than 60%, the core has a diameter of 34.7 to 42.0 mm, the core undergoes deflection amounting to 2.5 to 5.0 mm under a load of 100 kg, the cover has an outermost cover layer which is formed mainly from a thermoplastic resin or elastomer, the outermost cover layer has a Shore D hardness of 55 to 70 and a thickness of 0.5 to 2.0 mm, and the ball weighs 40.0 to 44.9 g. The solid golf ball specified above exhibits good flying performance with a high initial velocity, a small amount of spin, and a large hitting angle, while retaining good crack resistance. In addition, it permits novice golfers to increase flying distance even at a low head speed in the order of 30 m/s. The finding mentioned above led to the present invention.

Thus, the present invention is directed to a solid golf ball as defined in the following.

[1] A solid golf ball made up of a core and at least one cover layer, wherein the core is formed mainly from a polybutadiene which is synthesized with using a catalyst of rare earth element such that the content of cis-1,4 bond is no less than 60%, the core has a diameter of 34.7 to 42.0 mm, the core undergoes deflection amounting to 2.5 to 5.0 mm under a load of 100 kg, the cover has an outermost cover layer which is formed mainly from a thermoplastic resin or elastomer compounded with organic short fibers, the outermost cover layer has a Shore D hardness of 55 to 70 and a thickness of 0.5 to 2.0 mm, and the ball weighs 40.0 to 44.9 g.

[2] The solid golf ball of [1], wherein the outermost cover layer is made mainly of an ionomer resin.

[3] The solid golf ball of [1], wherein the thermoplastic resin or elastomer for the outermost cover layer is one which does not increase in Shore D hardness by more than 3 before and after blending with organic short fibers.

[4] The solid golf ball of [1], wherein the outermost cover layer is made mainly of a resin composition which is a mixture of component (a) which is selected from olefin-unsaturated carboxylic acid copolymer, olefin-unsaturated carboxylic acid-unsaturated carboxylic ester copolymer, and their salt neutralized with metal ions, and component (b) which is a binary copolymer composed of a polyolefin component and a polyamide component.

[5] The solid golf ball of [4], wherein the polyamide component in component (b) is nylon fibers.

Incidentally, the term "mainly" means that the material constituting the core and the outermost cover layer accounts for no less than 50 wt %, particularly 60 to 100 wt %, of the total amount of the materials.

DETAILED DESCRIPTION OF THE INVENTION

The invention will be described in more detail in the following.

The present invention is embodied in a solid golf ball consisting of a core and at least one cover layer. The golf ball should have a weight ranging from 40.0 to 44.9 g, preferably from 40.5 to 44.5 g, more preferably from 41.0 to 44.0 g. This specific weight is necessary for the golf ball to increase in the initial velocity and to achieve a high projectile. The golf ball achieves an extended flying distance even when it is hit with a low head speed.

The golf ball may be formed in the usual way so that it has a diameter no smaller than 42.67 mm, preferably from 42.67 to 43.00 mm.

The core may be formed from a rubber compound containing a co-crosslinking agent, organic peroxide, inert filler, organosulfur compound, and the like. The rubber compound should preferably be based on a polybutadiene.

The polybutadiene should preferably be one which has cis-1,4-bonds in the polymer chain accounting for no less than 60 wt %, preferably no less than 80 wt %, more preferably no less than 90 wt %, and most desirably no less than 95 wt %. With an excessively low content of cis-1,4-bonds in the molecule, the resulting polybutadiene will be poor in rebound resilience.

In addition, the polybutadiene should preferably be one which has 1,2-vinyl bonds in the polymer chain accounting for no more than 2%, preferably no more than 1.7%, and more preferably no more than 1.5%. With an excessively high content of 1,2-vinyl bonds in the molecule, the resulting polybutadiene will be poor in rebound resilience.

The polybutadiene mentioned above should preferably be one which is synthesized with using a catalyst of rare earth element, so that the polybutadiene-based rubber compound exhibits good rebound resilience after vulcanization.

The catalyst of rare earth element mentioned above is not specifically restricted. It may be a compound of lanthanoid rare earth element combined with an organoaluminum compound, alumoxane, halogen-containing compound, and Lewis base (optional).

The compound of lanthanoid rare earth element may be in the form of halide, carboxylate, alcoholate, thioalcoholate, or amide of a metal with an atomic number 57 to 71.

Of the catalyst of lanthanoid rare earth element mentioned above, that of neodymium compound is desirable because it effectively yields polybutadiene with a high content of 1,4-cis bonds and a low content of 1,2-vinyl bonds. Its examples are disclosed in Japanese Patent Laid-open Nos. Hei 11-35633, Hei 11-164912, and 2002-293996.

The polybutadiene synthesized with using a catalyst of lanthanoid rare earth element should account for no less than 10 wt %, preferably no less than 20 wt %, particularly no less than 40 wt %, of the total amount of the rubber compound for improved rebound resilience.

Incidentally, the base material of the rubber compound mentioned above may contain, in addition to the polybutadiene mentioned above, any other rubber components, insofar as the effects of the invention are not compromised. Such additional rubber components include polybutadiene (excluding the one mentioned above), diene rubber (such as styrene-butadiene rubber), natural rubber, isoprene rubber, and ethylene-propylene-diene rubber.

Examples of the co-crosslinking agent include unsaturated carboxylic acids and metal salts thereof.

Examples of unsaturated carboxylic acids include acrylic acid, methacrylic acid, maleic acid, and fumaric acid. Preferable among them are acrylic acid and methacrylic acid.

Metal salts of unsaturated carboxylic acids may be exemplified by those which are obtained by neutralizing the above-mentioned unsaturated carboxylic acid with specific metal ions. They include, without specific restrictions, a zinc or magnesium salt of acrylic acid or methacrylic acid. Preferable among them is zinc acrylate.

The amount of the unsaturated carboxylic acid and/or metal salt thereof to be compounded into 100 pbw of the base rubber should be no less than 10 pbw, preferably no less than 15 pbw, more preferably no less than 20 pbw, and no more than 60 pbw, preferably no more than 50 pbw, more preferably no more than 45 pbw, most desirably no more than 40 pbw. An excessively large amount will lead to a very poor striking feel owing to excessive hardness; and an excessively small amount will lead to low rebound resilience.

The organic peroxide mentioned above may be selected from commercial products, such as Percumyl D and Perhexa 3M (both from NOF Corporation) and Luperco 231XL (from Atochem). They may be used alone or in combination with one another.

The amount of the organic peroxide to be compounded into 100 pbw of the base rubber should be no less than 0.05 pbw, preferably no less than 0.1 pbw, more preferably no less than 0.2 pbw, most desirably no less than 0.3 pbw, and no more than 5 pbw, preferably no more than 4 pbw, more preferably no more than 3 pbw, most desirably no more than 2 pbw. An excessively large or small amount will lead to poor striking feel, poor durability, and low rebound resilience.

The inert filler includes, for example, zinc oxide, barium sulfate, and calcium carbonate. They may be used alone or in combination with one another.

The amount of the inert filler to be compounded into 100 pbw of the base rubber should be no less than 1 pbw, preferably no less than 5 pbw, and no more than 50 pbw, preferably no more than 40 pbw, more preferably no more than 30 pbw, most desirably no more than 20 pbw. An excessively large or small amount will lead to golf balls with an off-spec weight or low rebound resilience.

The rubber compound may optionally be compounded with an antioxidant, which is selected from commercial products, such as Nocrac NS-6 and NS-30 (from Ouchi-shinko Chemical Industrial Co., Ltd.), and Yoshinox 425 (from Yoshitomi Pharmaceutical Industries, Ltd.). They may be used alone or in combination with one another.

The amount of the antioxidant to be compounded into 100 pbw of the base rubber should be no less than 0 pbw, preferably no less than 0.05 pbw, more preferably no less than 0.1 pbw, most desirably no less than 0.2 pbw, and no more than 3 pbw, preferably no more than 2 pbw, more preferably no more than 1 pbw, most desirably no more than 0.5 pbw. An excessively large or small amount will lead to golf balls with poor durability and low rebound resilience.

The core mentioned above should preferably be compounded with an organosulfur compound so that the resulting golf ball has improved rebound resilience and an increased initial velocity.

The organosulfur compound is not specifically restricted so long as it contributes to the rebound resilience of the golf ball. It includes thiophenols, thionaphthols, halogenated thiophenols (or metal salts thereof), and polysulfides with 2 to 4 sulfur atoms. Their typical examples are pentachlorothiophenol, pentafluorothiophenol, pentabromothiophenol, p-chlorothiophenol, and their zinc salts; and diphenylpolysulfide, dibenzylpolysulfide, dibenzoylpolysulfide, dibenzothiazoylpolysulfide, and dithiobenzoylpolysulfide, which have 2 to 4 sulfur atoms. Preferable among them are zinc salt of pentachlorothiophenol and diphenyldisulfide.

The amount of the organosulfur compound to be compounded into 100 pbw of the base rubber should be no less than 0.05 pbw, preferably no less than 0.1 pbw, and no more than 5 pbw, preferably no more than 4 pbw, more preferably no more than 3 pbw, most desirably no more than 2.5 pbw. An excessively large amount does not produce any additional effect. An excessively small amount does not fully produce its effect.

The core should be formed such that it has a diameter no smaller than 34.7 mm, preferably no smaller than 35.0 mm, more preferably no smaller than 35.3 mm, and no larger than 42.0 mm, preferably no larger than 41.0 mm, more preferably no larger than 40.3 mm.

The core should be formed such that it undergoes deflection (under a load of 100 kg) which is no less than 2.5 mm, preferably no less than 3.0 mm, more preferably no less than 3.5 mm, and no more than 5.0 mm, preferably no more than 4.5 mm, more preferably no more than 4.2 mm.

The solid golf ball according to the present invention is characterized in that above-mentioned core is enclosed by a cover consisting of at least one layer. The cover may consist of two or more layers. The single layer arranged outside is referred to the "outermost cover layer" hereinafter.

The outermost cover layer mentioned above is formed mainly from a thermoplastic resin or elastomer compounded with organic short fibers. The composite material contributes to improved crack resistance. It is not specifically restricted in its composition. It should preferably be a mixture of component (a) which is selected from olefin-unsaturated carboxylic acid copolymer, olefin-unsaturated carboxylic acid-unsaturated carboxylic ester copolymer, and their salt neutralized with metal ions, and component (b) which is a binary copolymer composed of a polyolefin component and a polyamide component.

The component (a) mentioned above should be selected from olefin-unsaturated carboxylic acid binary random copolymer and olefin-unsaturated carboxylic acid-unsaturated carboxylic ester ternary random copolymer and their salt neutralized with metal ions. The olefin in the copolymer mentioned above should preferably be one which has a carbon number of 2 or more and 8 or less, particularly 6 or less. Its typical examples include ethylene, propylene butene, pentene, hexene, heptene, and octene. Preferable among them is ethylene.

Examples of the unsaturated carboxylic acid include acrylic acid, methacrylic acid, maleic acid, and fumaric acid. Preferable among them are acrylic acid and methacrylic acid.

The unsaturated carboxylic ester should preferably be the lower alkyl ester of unsaturated carboxylic acid mentioned above. Its typical examples include methyl (meth)acrylate, ethyl (meth)acrylate, propyl (meth)acrylate, and butyl (meth)acrylate. Preferable among them are n-butyl acrylate and i-butyl acrylate.

The above-mentioned component (a), which is either olefin-unsaturated carboxylic acid binary random copolymer or olefin-unsaturated carboxylic acid-unsaturated carboxylic ester ternary random copolymer, may be obtained by any known method of random copolymerization from the above-mentioned raw materials.

The above-mentioned random copolymer should be one which contains an unsaturated carboxylic acid in an adequately controlled amount. The amount of the unsaturated carboxylic acid contained in the component (a) should be no less than 4 wt %, preferably no less than 6 wt %, more preferably no less than 8 wt %, most desirably no less than 10 wt %, and no more than 30 wt %, preferably no more than 20 wt %, more preferably no more than 18 wt %, most desirably no more than 15 wt %.

The above-mentioned component (a), which is a salt (neutralized with metal ions) of either olefin-unsaturated carboxylic acid binary random copolymer or olefin-unsaturated carboxylic acid-unsaturated carboxylic ester ternary random copolymer, may be obtained by partly neutralizing acid groups in the random copolymer with metal ions. This component will be referred to as a metal ion neutralized product of random copolymer hereinafter.

Metal ions to neutralize acid groups include, for example, $Na^+$, $K^+$, $Li^+$, $Zn^{++}$, $Cu^{++}$, $Mg^{++}$, $Ca^{++}$, $Co^{++}$, $Ni^{++}$, and $Pb^{++}$. Of these examples, $Na^+$, $Li^+$, $Zn^{++}$, and $Mg^{++}$ are preferable, and $Zn^{++}$ are most desirable.

The metal ion neutralized product of random copolymer may be obtained by neutralizing the random copolymer with metal ions specified above. The metal ions may be in the form of formate, acetate, nitrate, carbonate, hydrogen carbonate, oxide, hydroxide, or alkoxide. There are no specific restrictions in the degree of neutralization of the random copolymer with metal ions.

According to the present invention, the metal ion neutralized product of random copolymer should preferably be an ionomer resin neutralized with zinc ions. This ionomer permits easy control of melt flow rate for improved moldability.

The component (a) mentioned above may be selected from commercial ones. Commercial binary random copolymers are Nucrel 1560, 1214, and 1035 (all from Du Pont-Mitsui Polychemicals Co., Ltd.) and Escor 5200, 5100, and 5000 (all from ExxonMobil Chemical). Commercial ternary random copolymers are Nucrel AN4311 and AN4318 (both from Du Pont-Mitsui Polychemicals Co., Ltd.) and Escor ATX325, ATX320, and ATX310 (all from ExxonMobil Chemical).

The metal ion neutralized product of binary random copolymer is commercially available under the trade name of Himilan 1554, 1557, 1601, 1605, 1706, and AM7311 (all from Du Pont-Mitsui Polychemicals Co., Ltd.), Surlyn 7930 (from Du Pont in USA), and Ioteck 3110 and 4200 (both from ExxonMobil Chemical). The metal ion neutralized product of ternary random copolymer is commercially available under the trade name of Himilan 1855, 1856, and 7316 (all from Du Pont-Mitsui Polychemicals Co., Ltd.), Surlyn 6320, 8320, 9320, 8120 (all from Du Pont in USA), Ioteck 7510 and 7520 (both from ExxonMobil Chemical). Of these commercial produces, Himilan 1706, 1557, and AM7316 are preferable, which are zinc-neutralized ionomer resins.

On the other hand, the component (b), which is a polyolefin, should preferably be any of low-density polyethylene (LDPE), high-density polyethylene (HDPE), polypropylene, and polystyrene. Preferable among them is polyethylene, particularly low-density polyethylene with a high crystallinity.

The polyamide component should be selected from nylon 6, nylon 66, nylon 11, nylon 12, nylon 610, nylon 612, copolymer nylon, nylon MXD6, nylon 46, aramid, polyamideimide, and polyimide. Of these products, nylon 6 is desirable because of its balanced price and physical properties. The polyamide component should be in the form of fiber. Nylon fiber is particularly desirable. The nylon fiber should have an average diameter no larger than 10 μm, preferably no larger than 5 μm, more preferably no larger than 1 μm, and no smaller than 0.01 μm. Such fine fibers efficiently produce the reinforcing effect. Incidentally, the average diameter is one which is measured by observing the cross section of samples under a transmission electron microscope.

The component (b) mentioned above should be in the form of composite material having a crystalline polyolefin component bonding to the surface of nylon fibers. The term "bonding" means that the polyolefin component and the polyamide component bind together through grafting with using a binder. Examples of the binder include silane coupling agents, titanate coupling agents, unsaturated carboxylic acids and derivatives thereof, and organic peroxides.

The component (b) mentioned above should contain the polyolefin component (b-1) and the polyamide component (b-2) such that the ratio of (b-1)/(b-2) by weight is from 25/75 to 95/5, preferably from 30/70 to 90/10, more preferably from 40/60 to 75/25. With an excessively small amount, the polyamide component will not fully produce the reinforcing effect. With an excessively large amount, the polyamide component will not mix well with the component (a) at the time of kneading in a twin-screw extruder or the like.

The components (a) and (b) mentioned above should be mixed with each other such that the ratio (a)/(b) by weight is from 100/0.1 to 100/50, preferably from 100/1 to 100/40, more preferably from 100/2 to 100/30. With an excessively small amount, the component (b) will not fully produce its effect. With an excessively large amount, the component (b) impairs mixing and molding into the cover layer.

The mixing temperature for the components (a) and (b) should be higher than the melting point of the polyolefin component, preferably by more than 10° C., and lower than the melting point of the polyamide component, preferably by more than 10° C., so that the polyamide component retains its shape as much as possible. This is not necessarily mandatory.

The molding into golf balls should be accomplished at a temperature within the above-mentioned temperature range, although this is not necessarily mandatory.

The resin compound composed essentially of the components (a) and (b) may optionally be compounded with a variety of additives, such as pigment, dispersing agent, antioxidant, UV light absorber, UV light stabilizer, mold release, plasticizer, and inorganic filler (including zinc oxide, barium sulfate, and titanium dioxide). The total amount of the components (a) and (b) in the resin compound should be no less than 30 wt %, preferably from 60 to 100 wt % in order to achieve the desired effects of the invention.

The outermost cover layer mentioned above should have a Shore D hardness no lower than 55, preferably no lower than 57, more preferably no lower than 61, and no higher than 70, preferably no higher than 68, more preferably no higher than 66. If the hardness is excessively low, the resulting golf ball is poor in flying performance due to low rebound resilience or excess spin. If the hardness is excessively high, the resulting golf ball is poor in striking feel and resistance to repeated hitting. Incidentally, the value of Shore D hardness is one which is obtained by measurement by a type D durometer according to ASTM D2240.

The thermoplastic resin or elastomer for the outermost cover layer should not increase in Shore D hardness by more than 3, particularly by more than 1, before and after blending with organic short fibers. Otherwise, the resulting golf ball will be poor in flying distance due to excessive spin.

The outermost cover layer should have a thickness no smaller than 0.5 mm, preferably no smaller than 1.0 mm, more preferably no smaller than 1.2 mm, and no larger than 2.0 mm, preferably no larger than 1.8 mm, more preferably no larger than 1.5 mm. With an excessively thin outermost cover layer, the resulting golf ball is poor in resistance to repeated hitting. With an excessively thick outermost layer, the resulting golf ball does not give a soft striking feel at the time of putting and approach shot and is poor in flying distance due to excessive spin when the head speed is low.

In the case where the cover consists of two or more layers, there exist one or more inner cover layers in addition to the outermost layer. The inner cover layers may be formed from any known thermoplastic resin or elastomer, which is selected from the materials used for the outermost cover layer. Preferred materials to be selected from the standpoint of good striking feel and improved rebound resilience are ionomer resins, olefin elastomers, styrene elastomers, polyester elastomers, urethane elastomers, and polyamide elastomers. They may be used alone or in combination with one another.

The inner cover layer should have a Shore D hardness no lower than 15, preferably no lower than 20, more preferably no lower than 30, and no higher than 60, preferably no higher than 55, more preferably no higher than 52. The inner cover layer should preferably be softer than the outermost cover layer (in terms of Shore durometer hardness). If the hardness is excessively high, the resulting golf ball lacks a soft striking feel at the time of putting and approach shot.

The inner cover layer should have a thickness no smaller than 0.5 mm, preferably no smaller than 0.7 mm, more preferably no smaller than 1.0 mm, and no larger than 2.0 mm, preferably no larger than 1.8 mm, more preferably no larger than 1.5 mm. With an excessively thin inner cover layer, the resulting golf ball lacks a soft striking feel at the time of putting and approach shot. With an excessively thick inner layer, the resulting golf ball is poor in flying distance due to excessive spin.

The golf ball according to the present invention may have dimples formed by any known method. There are no specific restrictions in the manufacturing method. The core, inner cover layer, and outermost cover layer may be formed by any known method, such as compression molding and injection molding.

As explained above, the solid golf ball according to the present invention excels in flying performance and crack resistance and permits novice players to increase flying distance with a low head speed. Moreover, it gives a soft striking feel when hit by a putter or driver.

EXAMPLES

The invention will be described in more detail with reference to the following Examples and Comparative Examples, which are not intended to restrict the scope thereof.

Examples 1 to 3 and Comparative Examples 1 to 4

A rubber compound for the core was prepared according to the formulation shown in Table 1. In each example and comparative example, a solid core was molded by vulcanization at 155° C. for 15 minutes. A resin compound for the cover layer was prepared according to the formulation shown in Table 2. The rubber compound and resin compound underwent injection molding to give a two-piece solid golf ball as specified in Table 3.

TABLE 1

| | | Example | | | Comparative Example | | | |
|---|---|---|---|---|---|---|---|---|
| | | 1 | 2 | 3 | 1 | 2 | 3 | 4 |
| Poly-butadiene | BR730 | 100 | 100 | 100 | | | | |
| | BR01 | | | | 50 | 50 | 50 | 50 |
| | BR11 | | | | 50 | 50 | 50 | 50 |
| Peroxide | Perhexa 3M-40 | 0.3 | 0.3 | 0.3 | 0.6 | 0.6 | 0.6 | 0.6 |
| | percumyl D | 0.3 | 0.3 | 0.3 | 0.6 | 0.6 | 0.6 | 0.6 |
| Anti-oxidant | Nocrac NS-6 | 0.1 | 0.1 | 0.1 | 0.1 | 0.1 | 0.1 | 0.1 |
| Zinc oxide | | 9.5 | 11.0 | 6.5 | 21.7 | 6.4 | 20.2 | 6.0 |
| Zinc acrylate | | 29.3 | 28.1 | 27.2 | 26.9 | 27.2 | 30.5 | 29.7 |
| Zinc stearate | | 5.0 | 5.0 | 5.0 | 5.0 | 5.0 | 5.0 | 5.0 |
| Zinc salt of pentachlorothiophenol | | 1.0 | 1.0 | 1.0 | 1.0 | 1.0 | 1.0 | 1.0 |

Note:
Expressed in terms of parts by weight.

The materials and trade names shown in Table 1 are specified as follows.

Polybutadiene BR730:

Nd catalyst, 96% cis-1,4-bonds, from JSR Corporation.

Polybutadiene BR01:

Ni catalyst, 96% cis-1,4-bonds, from JSR Corporation.

Polybutadiene BR11:

Ni catalyst, 96% cis-1,4-bonds, from JSR Corporation.

Perhexa 3M-40: 1,1-bis(t-butylperoxy)-3,5,5-trimethylcyclohexane, from NOF Corporation.

Percumyl D: dicumyl peroxide from NOF Corporation.

Antioxidant, Nocrac NS-6:

from Ouchishinko Chemical Industrial Co., Ltd.

TABLE 2

| | | Example | | | Comparative Example | | | |
|---|---|---|---|---|---|---|---|---|
| | | 1 | 2 | 3 | 1 | 2 | 3 | 4 |
| Cover | Himilan 1557 | 50 | | | | | | |
| | Himilan 1555 | 50 | | | | | | |
| | Himilan 1706 | | 25 | 25 | 50 | 50 | 50 | |
| | Himilan 1605 | | 50 | 50 | 50 | 50 | 50 | |
| | Surlyn 7930 | | | | | | | 65 |
| | Surlyn 6320 | | | | | | | 35 |
| | Surlyn 9945 | | 25 | 25 | | | | |
| | Polyolefin/polyamide binary copolymer | 5 | 5 | 5 | | | | |
| | Barium sulfate 300 | | | | | | | 15 |
| | Titanium oxide | 2 | 2 | 2 | 2 | 2 | 2 | 5 |
| | Magnesium stearate | 1 | 1 | 1 | 1 | 1 | 1 | 1 |

Note:
Expressed in terms of parts by weight.

The materials and trade names shown in Table 2 are specified as follows.

"Surlyn" series: Ionomer resin, from Du Pont in USA.

"Himilan" series:

Ionomer resin, from Du Pont-Mitsui Polychemicals Co., Ltd.

Polyolefin/polyamide binary copolymer:

"LA0010" from Daiwa Polymer, a 50/50 mixture (by weight) of low-density polyethylene and polyamide (nylon 6) short fibers.

Barium sulfate 300:

a product of Sakai Chemical Industry Co., Ltd.

The thus obtained two-piece solid golf balls were examined for flying performance, crack resistance, and striking feel in the following manner. The results are shown in Table 3.

Flying Performance

Each ball sample was tested for flying performance by measuring the total flying distance which it traveled when it was hit at a head speed (HS) of 35 m/s by a driver attached to a swing robot made by Miyamae Co., Ltd. (The driver is X-Drive Type 300, Prospec, with a loft angle of 10°, made by Bridgestone Sports Co., Ltd.) The spin and initial velocity were measured immediately after hitting by using a high-speed camera.

Crack Resistance

Each ball sample was tested for crack resistance by counting the number of hitting required for the ball to crack when the ball was repeatedly hit against a steel plate at an initial velocity of 43 m/s. The results are expressed in terms of relative value, with the reference value being 100. The reference value is the number of hitting required for the commercial golf ball (ALTUS NEWING) to crack.

Striking Feel

Each ball sample was evaluated by five medium and skilled amature golfers (fifties in age) with a head speed of 35–40 m/s. The striking feel was rated according to the following criterion, and the result is expressed in terms of average in three levels.

5 points: very soft 4 points: soft 3 points: mediocre 2 points: hard 1 point: very hard ○: An average more than 4 points Δ: An average of 2 to 4 points X: An average less than 2 points

TABLE 3

| | | Example | | | Comparative Example | | | |
|---|---|---|---|---|---|---|---|---|
| | | 1 | 2 | 3 | 1 | 2 | 3 | 4 |
| Core | Diameter (mm) | 40.3 | 39.9 | 39.9 | 39.9 | 39.9 | 38.5 | 40.3 |
| | Deflection (mm) | 3.7 | 3.9 | 4.2 | 3.9 | 4.2 | 3.2 | 3.7 |
| Cover | Thickness (mm) | 1.2 | 1.4 | 1.4 | 1.4 | 1.4 | 2.1 | 1.2 |
| | Hardness (Shore D) | 60 | 63 | 63 | 63 | 63 | 63 | 60 |
| | Hardness of base resin | 60 | 63 | 63 | 63 | 63 | 63 | 56 |
| Ball | Diameter (mm) | 42.7 | 42.7 | 42.7 | 42.7 | 42.7 | 42.7 | 42.7 |
| | Weight (g) | 43.5 | 43.5 | 42.5 | 45.5 | 42.5 | 45.5 | 43.5 |
| | Deflection (mm) | 3.2 | 3.2 | 3.5 | 3.2 | 3.5 | 2.6 | 3.2 |
| Flying performance, W#1, HS 35 | Spin (rpm) | 2860 | 2810 | 2760 | 2800 | 2760 | 2990 | 3050 |
| | Initial velocity (m/s) | 51.7 | 51.7 | 51.6 | 51.2 | 51.0 | 51.2 | 51.2 |
| | Flying distance (m) | 170.8 | 171.0 | 171.0 | 168.5 | 168.0 | 167.0 | 166.5 |
| Crack resistance | | 115 | 119 | 109 | 90 | 85 | 200 and up | 125 |

TABLE 3-continued

| | | Example | | | Comparative Example | | | |
|---|---|---|---|---|---|---|---|---|
| | | 1 | 2 | 3 | 1 | 2 | 3 | 4 |
| Striking feel | Driver | ○ | ○ | ○ | ○ | ○ | Δ | ○ |
| | Putting | ○ | ○ | ○ | ○ | ○ | X | ○ |

Note:
Hardness of core and ball: Amount of defection under a load of 100 kg.
Shore D hardness of cover: Values of hardness measured with a type D durometer according to ASTM D2240. Specimens in sheet form were prepared from each material.
Base resin hardness: Values of hardness measured in the same way as above, before compounded with organic short fibers, barium sulfate, etc.
Ball diameter: This is the diameter measured at the ball surface where there is no dimple.
Thickness of cover: Expressed in terms of half the difference in diameter measured for the sphere before and after covering with the cover.

It is noted from Table 3 that the two-piece golf balls according to the present invention excel in flying performance (with a low head speed) and crack resistance and gives a soft striking feel when hit by a putter or driver. By contrast, the golf balls in Comparative Example 1, which is as heavy as ordinary balls, is low in initial velocity and poor in durability because its cover is not compounded with organic short fibers. Also, the golf ball in Comparative Example 2, with its cover not containing organic short fibers, is poor in durability. The golf balls in Comparative Example 3, which is as heavy as ordinary balls, is low in initial velocity and poor in striking feel because the cover is thick and the ball as a whole is hard. The sample in Comparative Example 4 is poor in flying performance because of the soft base resin which increases spin.

The samples in Comparative Examples 1 to 4 are poor in flying performance with a low initial velocity because their cores are not formed from the polybutadiene polymerized with using a catalyst of rare earth element.

Examples 4 to 6 and Comparative Examples 5 to 7

A rubber compound for the core was prepared according to the formulation shown in Table 4. In each example and comparative example, a solid core was molded by vulcanization at 155° C. for 15 minutes. A resin compound for the inner cover layer and outermost cover layer was prepared according to the formulation shown in Table 5. The rubber compound and resin compound underwent injection molding to give a three-piece solid golf ball as specified in Table 6.

TABLE 4

| | | Example | | | Comparative Example | | |
|---|---|---|---|---|---|---|---|
| | | 4 | 5 | 6 | 5 | 6 | 7 |
| Polybutadiene | BR730 | 100 | 100 | 100 | | | |
| | BR01 | | | | 50 | 50 | 50 |
| | BR11 | | | | 50 | 50 | 50 |
| Peroxide | Perhexa 3M-40 | 0.3 | 0.3 | 0.3 | 0.6 | 0.6 | 0.6 |
| | percumyl D | 0.3 | 0.3 | 0.3 | 0.6 | 0.6 | 0.6 |
| Antioxidant | Nocrac NS-6 | 0.1 | 0.1 | 0.1 | 0.1 | 0.1 | 0.1 |
| Zinc oxide | | 3.2 | 16.2 | 10.5 | 3.1 | 24.0 | 11.8 |
| Zinc acrylate | | 28.6 | 27.5 | 29.2 | 28.6 | 27.6 | 28.0 |
| Zinc stearate | | 5.0 | 5.0 | 5.0 | 5.0 | 5.0 | 5.0 |

TABLE 4-continued

| | Example | | | Comparative Example | | |
|---|---|---|---|---|---|---|
| | 4 | 5 | 6 | 5 | 6 | 7 |
| Zinc salt of pentachlorothiophenol | 1.0 | 1.0 | 1.0 | 1.0 | 1.0 | 1.0 |

Note:
Expressed in terms of parts by weight.

The materials and trade names shown in Table 4 are the same as those given in Table 1.

TABLE 5

| | | Example | | | Comparative Example | | |
|---|---|---|---|---|---|---|---|
| | | 4 | 5 | 6 | 5 | 6 | 7 |
| Inner cover layer | Hytrel 4047 | 100 | | 100 | 100 | 100 | |
| | Surlyn 8120 | | 75 | | | | 75 |
| | Dynalon 6100P | | 25 | | | | 25 |
| | Behenic acid | | 20 | | | | 20 |
| | Calcium hydroxide | | 2.3 | | | | 2.3 |
| Outermost cover layer | Himilan 1557 | | 50 | | | | |
| | Himilan 1555 | | 50 | | | | |
| | Himilan 1706 | 25 | | 25 | 50 | 50 | |
| | Himilan 1605 | 50 | | 50 | 50 | 50 | |
| | Surlyn 7930 | | | | | | 65 |
| | Surlyn 6320 | | | | | | 35 |
| | Surlyn 9945 | 25 | | 25 | | | |
| | Polyolefin/polyamide binary copolymer | 5 | 5 | 5 | | | |
| | Barium sulfate 300 | | | | | | 15 |
| | Titanium oxide | 2 | 2 | 2 | 2 | 2 | 5 |
| | Magnesium stearate | 1 | 1 | 1 | 1 | 1 | 1 |

Note:
Expressed in terms of parts by weight.

"Hytrel 4047": Thermoplastic polyester elastomer, from Du Pont-Toray Co., Ltd.

"Dynalon 6100P": Thermoplastic olefin elastomer, from JSR Corporation.

Other materials and trade names are the same as those given in Table 2.

The thus obtained three-piece golf balls were tested to evaluate flying performance, crack resistance, and striking feel in the same way as mentioned above. The results are shown in Table 6.

TABLE 6

| | | Example | | | Comparative Example | | |
|---|---|---|---|---|---|---|---|
| | | 4 | 5 | 6 | 5 | 6 | 7 |
| Core | Diameter (mm) | 35.3 | 37.7 | 37.2 | 35.3 | 37.2 | 37.7 |
| | Deflection (mm) | 4.0 | 3.9 | 3.7 | 4.0 | 3.7 | 3.9 |
| Inner cover layer | Thickness (mm) | 39.7 | 40.2 | 39.7 | 39.7 | 39.7 | 40.2 |
| | Hardness (Shore D) | 1.70 | 1.25 | 1.25 | 1.70 | 1.25 | 1.25 |
| | Hardness of base resin | 40 | 51 | 40 | 40 | 40 | 51 |
| Outermost cover layer | Thickness (mm) | 1.5 | 1.25 | 1.5 | 1.5 | 1.5 | 1.25 |
| | Hardness (Shore D) | 63 | 60 | 63 | 63 | 63 | 60 |
| | Hardness of base resin | 63 | 60 | 63 | 63 | 63 | 56 |
| Ball | Diameter (mm) | 42.7 | 42.7 | 42.7 | 42.7 | 42.7 | 42.7 |
| | Weight (g) | 42.5 | 43.5 | 43.5 | 42.5 | 45.5 | 43.5 |
| | Deflection (mm) | 3.2 | 3.3 | 3.1 | 3.2 | 3.1 | 3.3 |
| Flying performance, W#1, HS 35 | Spin (rpm) | 2890 | 2850 | 2860 | 2890 | 2870 | 3030 |
| | Initial velocity (m/s) | 51.8 | 51.5 | 51.7 | 51.1 | 51.2 | 51.3 |
| | Flying distance (m) | 171.0 | 170.0 | 170.6 | 168.2 | 168.6 | 167.5 |
| Crack resistance | | 115 | 131 | 125 | 80 | 90 | 140 |
| Striking feel | Driver | ○ | ○ | ○ | ○ | ○ | ○ |
| | Putting | ○ | ○ | ○ | ○ | ○ | ○ |

Shore D hardness of inner cover layer:

Values of hardness measured with a type D durometer according to ASTM D2240. Specimens in sheet form were prepared from the material for inner cover layer.

Other items were measured in the same way as in Table 3.

It is noted from Table 6 that the three-piece golf balls according to the present invention excel in flying performance with a low head speed and crack resistance and gives a good striking feel when hit by a putter or driver. By contrast, the golf balls in Comparative Examples 5 and 6, which have the outermost cover layer containing no organic short fibers, are poor in durability. The golf ball in Comparative Example 6, which is as heavy as ordinary balls, is low in initial velocity. Also, the golf ball in Comparative Example 7 is poor in flying performance because of the soft base resin which increases spin.

The samples in Comparative Examples 5 to 7 are poor in flying performance with a low initial velocity because their cores are not formed from the polybutadiene polymerized with using a catalyst of rare earth element.

The invention claimed is:

1. A solid golf ball made up of a core and at least one cover, wherein said core is formed mainly from a polybutadiene which is synthesized by using a catalyst of rare earth element such that the content of cis-1,4 bond is no less than 60%, said core has a diameter of 34.7 to 42.0 mm, said core undergoes deflection amounting to 2.5 to 5.0 mm under a load of 100 kg, said cover has an outermost cover layer which is formed mainly from a resin composition which is a mixture of component (a) which is selected from olefin-unsaturated carboxylic acid copolymer, olefin-unsaturated carboxylic acid-unsaturated carboxylic ester copolymer, and their salt neutralized with metal ions, and component (b) which is a binary copolymer composed of a polyolefin component (b-1) and a polyamide component (b-2), said outermost cover layer has a Shore D hardness of 55 to 70 and a thickness of 0.5 to 2.0 mm, and said ball weighs 40.0 to 44.9 g.

2. The solid golf ball of claim 1, wherein the resin composition for the outermost cover layer does not increase in Shore D hardness by more than 3 before and after blending component (a) with component (b).

3. The solid golf ball of claim 1, wherein the polyamide component (b-2) in component (b) is nylon fibers.

4. The solid golf ball of claim 1, wherein the ratio of (b-1)/(b-2) by weight of polyolefin component (b-1) and polyamide component (b-2) is from 25/75 to 95/5.

5. The solid golf ball of claim 1, wherein the ratio of (a)/(b) by weight of component (a) and component (b) is from 100/0.1 to 100/50.

6. The solid golf ball of claim 1, wherein polyolefin component (b-1) is a crystalline polyolefin component, polyamide component (b-2) is nylon fibers, and component (b) is in the form of a composite material having the crystalline polyolefin component bonded to the surface of nylon fibers.

7. The solid golf ball of claim 1, wherein said ball weighs 41.0 to 44.0 g.

8. The solid golf ball of claim 1, wherein said core is compounded with an organosulfur compound.

* * * * *